US005090168A

United States Patent [19]

Fast et al.

[11] Patent Number: 5,090,168

[45] Date of Patent: Feb. 25, 1992

[54] EXTRUDED WINDOW FRAME SYSTEM

[75] Inventors: William A. Fast; Daniel E. Friesen, both of Winnipeg, Canada

[73] Assignee: Willmar Window Industries Ltd., Winnipeg, Canada

[21] Appl. No.: 515,425

[22] Filed: Apr. 27, 1990

[51] Int. Cl.[5] ..... E04B 1/04

[52] U.S. Cl. ..... 52/213; 52/215; 52/400; 52/475; 52/656; 52/586

[58] Field of Search ..... 52/204, 208, 213-215, 52/656, 475, 586, 775, 400

[56] References Cited

U.S. PATENT DOCUMENTS

| | | | |
|---|---|---|---|
| 2,187,490 | 1/1940 | Dewey et al. | 52/215 X |
| 2,249,257 | 7/1941 | Rumney et al. | 52/214 X |
| 2,834,071 | 5/1958 | Camerino | 52/214 |
| 3,214,873 | 11/1965 | Davis | 52/775 X |
| 4,821,472 | 4/1989 | Tix | 52/213 |

*Primary Examiner*—Richard E. Chilcot, Jr.
*Attorney, Agent, or Firm*—Adrian D. Battison; Stanley G. Ade; Murray E. Thrift

[57] ABSTRACT

A window frame system includes four basic profiles for new building construction and for various other projects including renovation, bow and bay constructions. One profile includes an outer profile for engagement with the wall of a new building in which the distance between the inside wall of the profile and a nailing fin is at least 6.5 inches. The height of the profile is then reduced to accomodate this larger width. A cross mullion is provided and a sash frame profile is also provided. The inner wall of the outer frame and the side walls of the mullion are arranged for cooperation either with a picture window unit or with the sash frame. The fourth profile comprises a renovation/bow profile which can be inserted into an existing window frame or can be snapped together alongside similar profiles to form a bow or bay construction.

13 Claims, 3 Drawing Sheets

EXTRUDED WINDOW FRAME SYSTEM

BACKGROUND OF THE INVENTION

This invention relates to an extruded window frame system of a type which includes a number of profiles extruded from a plastics material which can be cut and joined at the corners to form generally rectangular window frame elements which are connected together to form a window frame and glazing structure.

Many proposals have been made for arrangements of this type and extruded plastics materials (particularly PVC) have recently become more important in the market place in view of the higher insulating values available than metal materials and in view of the longer lasting effects or improved resistance to deterioration relative to wood.

SUMMARY OF THE INVENTION

It is one object of the present invention, therefore, to provide a window frame system which is particularly adapted for use in newly constructed housing.

It is a further object of the present invention to provide a window system in which the various profiles can be used either in a renovation window system or in a system for new housing with many of the profiles being usable in both systems thus reducing the number of profiles and window construction necessary to be stocked and supplied for different end uses.

According to a first aspect of the invention, there is provided a window system comprising a plurality of window profiles each extruded from a plastics material including an outer frame profile for cutting into four outer window frame elements which can be connected at respective ends thereof to form a rectangular outer window frame structure, the outer frame profile including an outer wall for engaging an opening formed in the wall of a building, an inner wall facing inwardly of the opening and including means for mounting a window unit in the window frame structure including a tower portion projecting inwardly against which the window unit abuts, means defining a nailing fin for abuting an outside wall surface of the building, a sill portion projecting from the nailing fin in a direction toward the outside of the building, means defining an inside surface facing inside the building for receiving an inside facing strip at the inside wall surface of the building, and a plurality of interior connecting walls extending across the profile from the inner wall to the outer wall, the profile having at least a portion thereof extending from the nailing fin to the inside surface which is formed as an integral single unit and which has a dimension from the nailing fin to the inside surface at least equal to 6.5 inches.

According to a second aspect of the invention there is provided a window system comprising a plurality of window profiles each extruded from a plastics material including an outer frame profile for cutting into four outer window frame elements which can be connected at respective ends thereof to form a rectangular outer window frame structure, the outer frame profile including an outer wall for engaging an opening formed in the wall of a building, an inner wall facing inwardly of the opening and including means for mounting a window unit in the window frame structure including a tower portion projecting inwardly against which the window unit abuts, means defining a nailing fin for abuting an outside wall surface of the building, a sill portion projecting from the nailing fin in a direction toward the outside of the building, means defining an inside surface facing inside the building for receiving an inside facing strip at the inside wall surface of the building, and a plurality of interior connecting walls extending across the profile from the inner wall to the outer wall, the inner wall including an inside portion extending from the inside surface, a sill portion extending from an outside surface of the profile toward the inside of the building and a central raised portion between the inside portion and the sill portion, the central raised portion being arranged for cooperation with the window unit and having the tower mounted at a position thereon adjacent the inside portion, the inside portion lying parallel to the outer wall and the sill portion being inclined from the raised portion in a direction toward the outside surface and toward the outer surface, a sash frame profile having an inner wall, an outer wall, an outside wall and an inside wall, the inner wall defining a tower portion and including recess means for receiving a snap fastening abutment portion for engagement of a window unit therebetween, the inside wall including a portion thereof for engaging the tower of the outer frame profile, a cross mullion frame profile for extending between the central raised portion on one side of the frame and the central raised portion on one side of the frame and the central raised portion on the opposed side of the frame, and including an upper wall including a tower projecting upwardly therefrom, a lower wall including a second tower projecting downwardly therefrom. An inside wlal and an outside wall, both the upper and lower walls including recess means for receiving a snap fitting abutment portion for cooperating with the tower, and a renovation frame profile having an outer wall for engaging an inner surface of a window frame, an inner wall facing inwardly of the opening and including means for mounting a window unit in the frame defined by the renovation frame profile, an inside wall and an outside wall.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
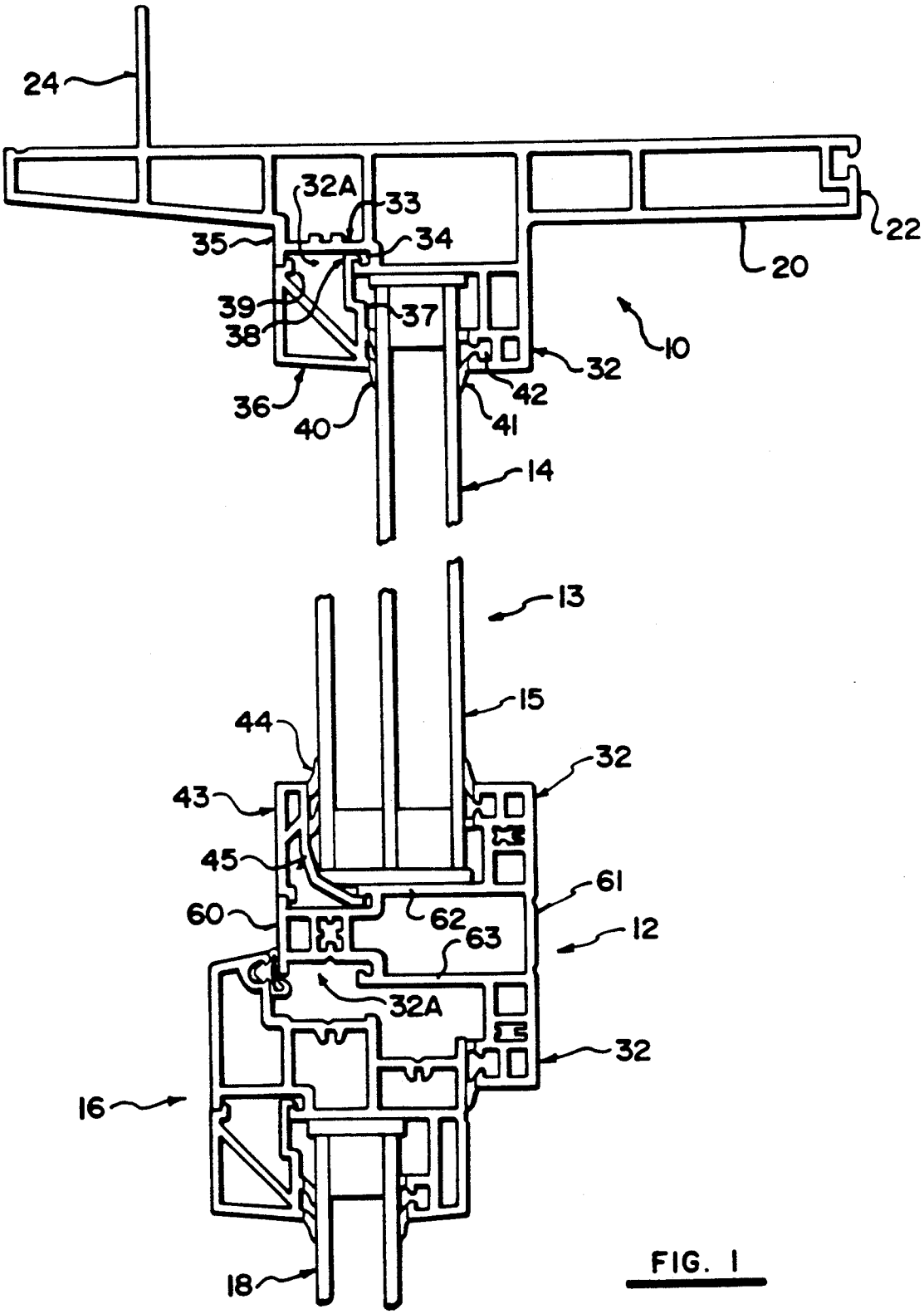
FIG. 1 is a cross-sectional view showing the different profiles of a window system which is particularly adapted for use in construction of new housing.
Figure 1A:
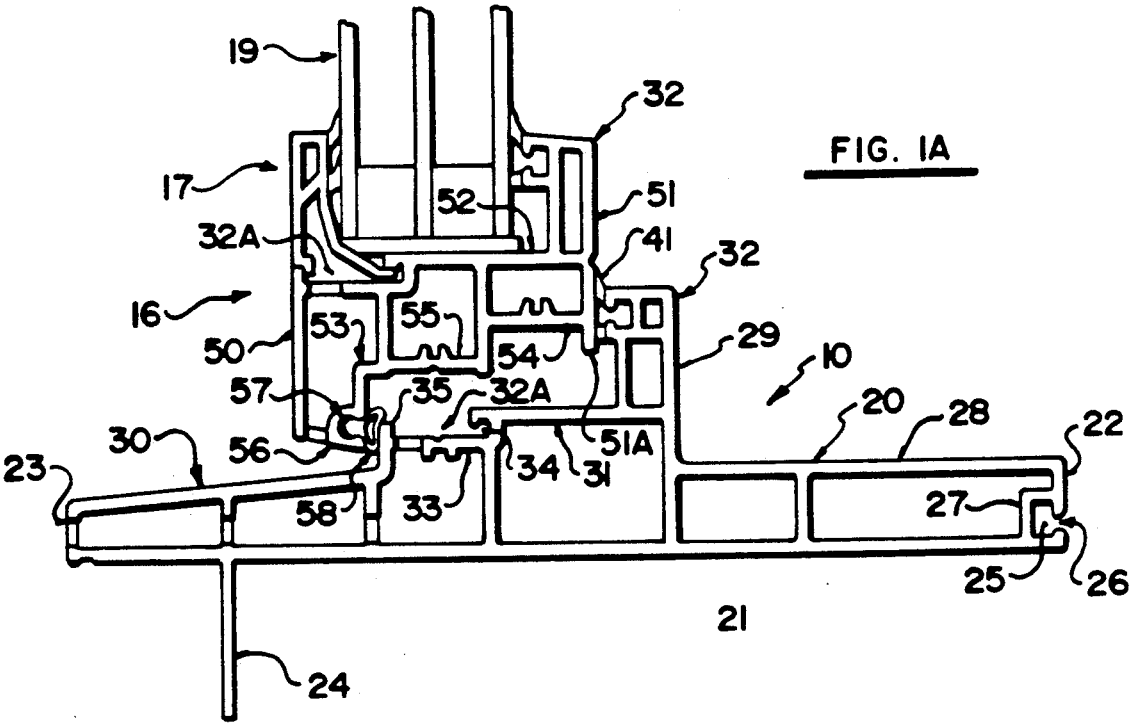
Figure 2:
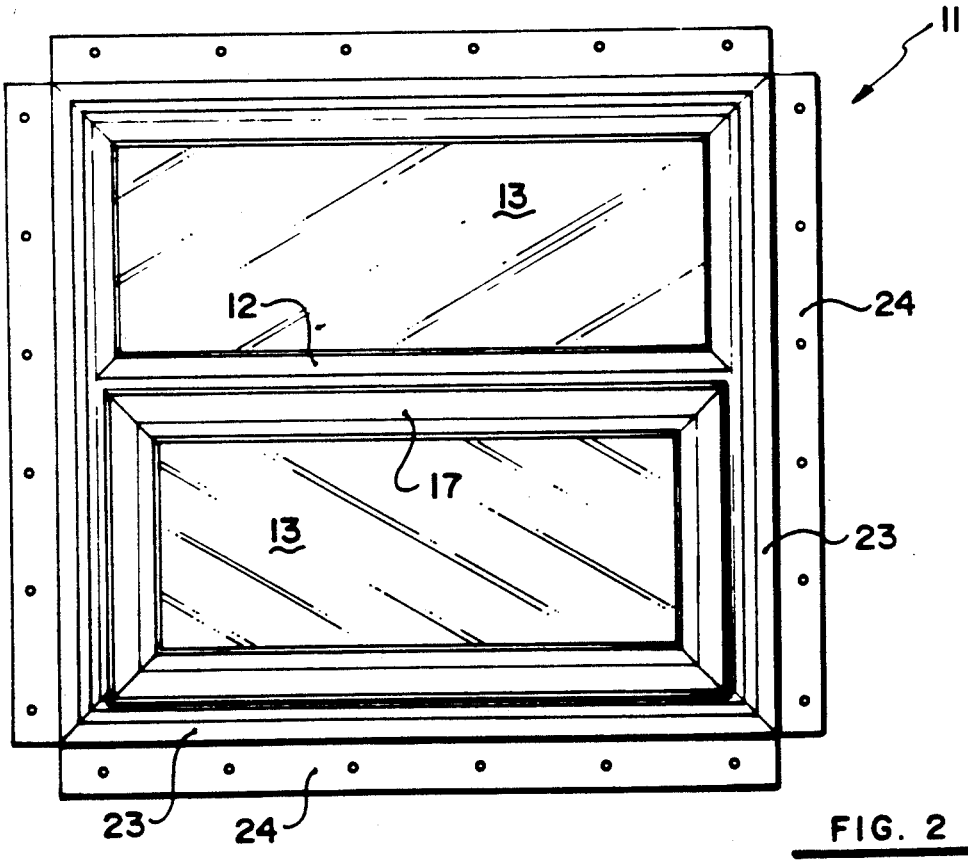
FIG. 2 is a front elevational view of the window of FIG. 1.

The window systems as shown in FIGS. 1 and 2 comprises an outer profile 10 which is cut into four lengths which are then mitred at the four corners to form a rectangular window frame generally indicated at 11. The window frame system further includes a cross mullion profile 12 which is connected across the outer frame 11 by attachment of the outer ends of a cut piece of the profile 12 to the side profiles 10 of the outer frame.

As shown in FIG. 1 between the upper outer frame and the cross mullion profile is mounted a picture window unit 13 which is shown in an upper part of the drawing as a dual pane portion 14 and is shown in the lower part of the drawing as a tri-pane portion 15.

The system further includes a sash frame profile 16 which is similarly cut into four lengths which are connected again at the corners to form a rectangular sash frame 17 which is mounted in the window frame between the lower outer frame profile and the underside of the cross mullion.

All of the profiles are extruded from a suitable plastics material which conventionally is PVC although other materials are possible or may become available. Using PVC, the corners are formed by cutting the profile to form a mitre joint and by welding the cut pieces together at the mitre joints to form a rigid structural unit for receiving the glazing.

For convenience of illustration the operating mechanisms for the sash frame are omitted as these are well known to one skilled in the art and various different types of operating mechanism can be possible to allow suitable movement of the sash frame relative to the main outer frame.

Again in FIG. 1 the upper part of the sash window is shown glazed with a dual-pane window unit 18 and a lower part is shown glazed with a tri-pane window unit 19 to show that these alternatives may be used with the same window system.

Turning now the details of the outer frame profile 10, this profile includes an inner wall 20 an outer wall 21. The outer wall 21 is arranged for engagement with the inside surface of an opening formed in a building wall and the inner wall faces inwardly toward a centre of the opening. The profile further includes an inside wall 22 which faces to the interior or inside of the building when attached into the opening. An outside wall 23 faces outside of the building.

The outer wall 21 is substantially flat so as to rest directly upon a flat surface defined at the opening in the building. The outside wall carries a nailing fin 24 which projects at right angles to the outer wall 21 at a position spaced inwardly from the outside wall 23. The nailing fin is arranged for engagement with the outer surface of the building when the window frame is inserted into position. When the nailing fin engages the front wall surface, the window frame can be fixed in place by suitable fasteners engaging the nailing fin into the front surface. The nailing fin is recessed from the outside wall 23 so as to provide a sill portion which hangs out over the front surface of the wall of the building. The outside wall 23 is simply a short vertical wall connecting between the outer wall and the inner wall of the profile.

The inside wall 22 comprises substantially a plain vertical wall but includes a recess 25 forming an opening 26 and enclosing wall 27 of the recess into which a finishing plate (not shown) can be snap fastened to lie against the inside surface of the wall of the building.

The inner wall of the profile comprises an inside portion 28 which lies simply parallel to the outer wall 21, a central raised portion generally indicated at 29 and an outer sill portion 30 which extends from the outer edge of the central raised portion to the outside wall 23. The sill portion of the inner wall is inclined so that it extends toward the outside and at the same time tapers towards the outer wall to provide a water shedding action on the outside of the building.

The central raised portion includes a wall 31 parallel to the outer wall 21. At the inside end of the wall 31 is provided a tower 32 which projects inwardly toward the centre of the frame. At the outside end of the wall 31 is provided a recess arrangement 32A including a horizontal wall 33, a shallow recess 34 and an end wall 35.

Between the inner wall 20 and the outer wall 21 is provided a plurality of connecting walls which provide structural strength to support the profile and prevent its collapse when pressed in the outward direction and also divide the profile into a number of separate chambers which prevent air movement across the full width of the profile thus giving a greater insulation effect.

As shown in the upper part of FIG. 1, the outer frame profile 10 can be used to cooperate with a dual-pane picture window 14 which is formed of two panes of glass separated by a spacer and sealed at the edges by a conventional technique as is well known to one skilled in the art. The dual pane window unit is mounted in place against the tower 32 by a cooperating abutment portion 36 which engages as a snap fastening into the recess 32A. Thus the abutment member includes an outer wall 37 for engaging against the glass and a pair of hook fingers 38 and 39 which engage into respective sides of the recess 32A to snap into place thus pressing the wall 37 against the window unit 14. The abutment profile 36 is formed with a pair of coextruded fins 40 on the wall 37 projecting against the glass and projecting away from the profile toward the centre of the glass to act in a water shedding action.

Similarly the tower 32 includes a pair of coextruded soft fins 41 provided on either side of an opening 42 at the top of the tower and facing toward the glass. The glass can therefore be simply pressed into place against the tower and snapped into place by operation of the abutment portion 36 without the necessity for any sealant.

A further abutment portion 43 forms a part of the system and can be used in the recess 32A in place of the abutment portion 36 to accomodate a tripane window unit 15 as shown in cooperation with the cross mullion profile 12. This second abutment portion has the same projecting fingers for engaging into the recess 32A but is of reduced width so as to accomodate the increased thickness of the tri-pane unit with the fins 44 mounted on an inner wall 45 of the portion for engaging the outer most one of the glass panes.

As shown in the bottom part of the window unit of FIG. 1, the outer profile 10 can also cooperate with the sash frame 16. Thus the sash frame 16 includes an outside wall 50, an inside wall 51, an inner wall 52 and an outer wall 53. The inner wall 52 is shaped identically to the inner wall of the central raised portion of the outer profile 10 so that it includes a tower 32 and a recess 32A operating identically to those previously described. The inside and outside walls are simply vertical walls and the inside wall 51 is arranged for cooperation with the fins 41 of the tower 32. The outer wall 53 is formed a plurality of steps 54, 55, 56 which descend from a position adjacent the top of the tower 32 to a position beneath the upper most edge of the wall 35 at the left hand end of the recess 32A. On an inside face of the step 56 is provided a recess 57 for a tubular type weather strip 58 inserted into the recess and projecting outwardly so as to enagage the wall 35. The inside wall 51 includes a downward projection 51A beyond the step 54 so that this can cooperate with the lower most one of the fins 41. Thus the raised central section of the profile 10 is shaped to cooperate with the outer surface of the sash frame profile 16 so that it can be closed into a sealing abuting position against the outer frame profile 10.

The cross mullion profile 12 includes an outside wall 60, an inside wall 61, an upper wall 62 and a lower wall 63. The upper and lower walls 62 and 63 are symmetrical and each is identical to the raised centre portion of the outer profile 10 so as to include a tower 32 and a recess 32A. As shown in FIG. 1 the upper wall cooperates with the picture window unit using the snap in abutment member and the lower wall 63 cooperates with the sash frame profile 16 as previously described.

For use with new building construction, the outer profile 10 is dimensioned so that the distance between the nailing fin 24 and the inside wall 22 is at least 6.5 inches. This enables a single outer profile to bridge the full space across the conventional 6.5 inch wall which is now adopted basically as a standard within new building construction where insulation values are of importance. In order to achieve this very wide profile from the outside wall 23 to the inside wall 22, the distance between the outer wall and the inner wall 20 is reduced so that the spacing between the inside portion 28 of the inner wall and the outer wall 21 is in the range 0.765 to 0.770 inches and preferably 0.768 inches. The sill portion is similarly spaced. In addition the height of the tower is reduced relative to conventional arrangements so that the top of the tower is spaced from the outer wall 21 by a distance in the range 2.000 to 2.10 inches and preferably 2.047 inches.

This enables the profile to be cut and machined on conventional machining tools since the total height between the top of the tower and the bottom of the fin 24 is no greater than of the order of 3.21 inches.

Figure 3:
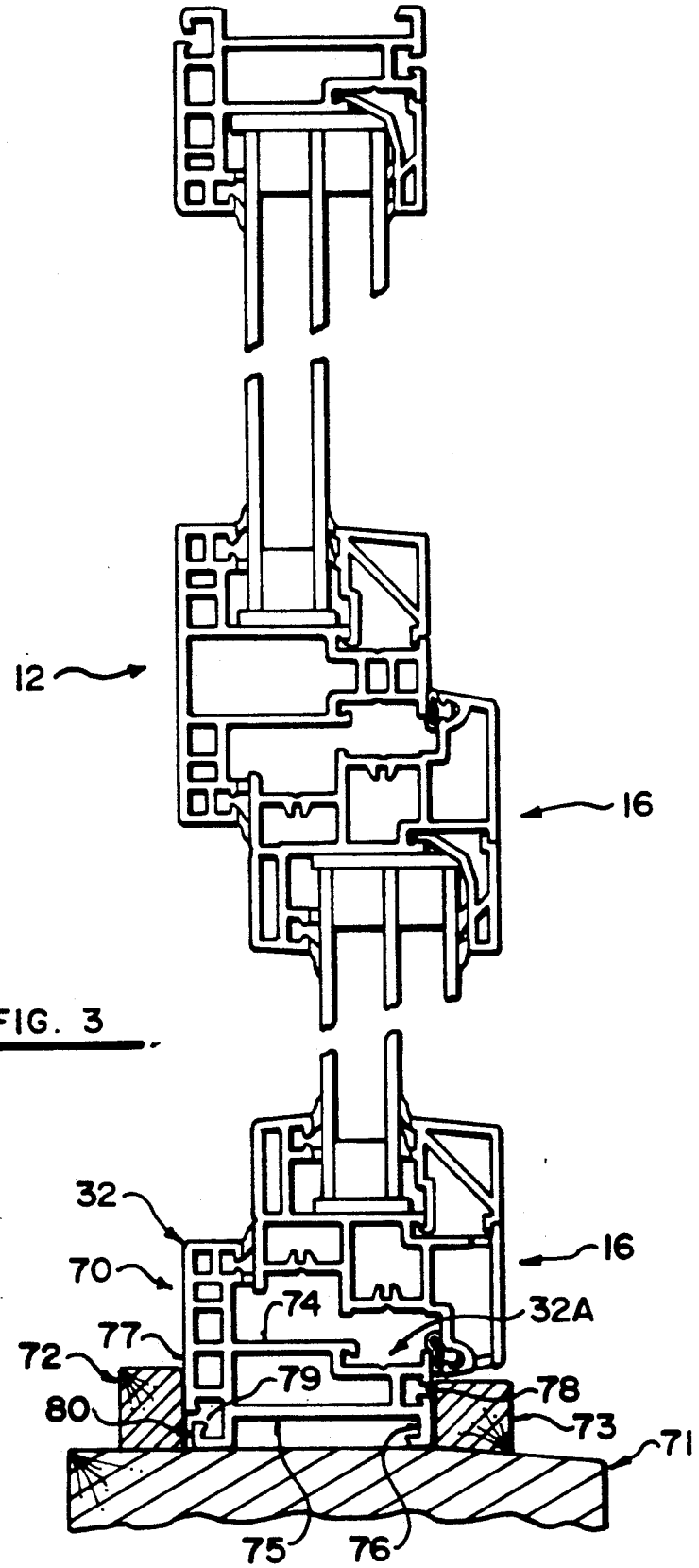
FIG. 3 is a similar cross-sectional view showing the profiles used for a window system to be employed in a renovation project.

Turning now to FIG. 3, there is provided a system for use in a renovation project which uses many parts from the system of FIG. 1. Specifically the system of FIG. 3 includes the cross mullion profile 12 and the sash frame profiles 16 as previously described. In this arrangement however a further profile is provided indicated at 70 which is an outer renovation type profile for mounting inside an existing outer frame 71 using stops 72 and 73 all of which are preferably but not necessarily of wood. The outer profile 70 includes an inner wall 74, an outer wall 75, an outside wall 76 and an inside wall 77. The inner wall 74 is identical to the central raised portion of the outer profile 10 and includes the tower 32 and the recess 32A. The outside wall 76 comprises a generally plain vertical wall but includes a recess 78. The inside wall 77 similarly comprises a vertical wall but includes a recess 79 with the wall 80 on the underside of the recess 79 being slightly set back from the plane of the inside wall. The width between the inside and outside walls is equal to the width of the raised centre portion and the width of the cross mullion profile 12. In the renovation construction shown in FIG. 3, the profile 70 is simply inserted between the stops 72 and 73 using a sealant material to prevent air infiltration around the outside of the window frame. The profile 70 can also be used in a bow or bay construction in which case the recesses 78 and 79 are used for closing strips which are snap fastened so as to bridge the space between the bow or bay section and the next adjacent bow or bay section. It is for this purpose that the wall portion 80 is slightly recessed so as to accomodate the bridging section snap fastened across the inside of the curvature of the bow or bay.

The system of the present invention thus uses four basic profiles which can be combined in different ways to provide a number of different constructions of window frames for use in new housing construction and in renovation projects.

In addition the window frame using the outer profile 10 is particularly useful in new building construction in view of the very simple installation and the smooth and clean completed frame thus formed.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A window frame structure comprising a rectangular outer window frame formed from four outer window profile elements each cut from a common outer window profile extruded from a plastics material to define for each outer window profile element a length and two ends, each end being connected to a respective one of the other outer window profile elements to form said rectangular outer window frame structure and a window unit mounted in the outer window frame, the outer frame profile including an outer wall for engaging an opening formed in a wall of a building, an inner wall facing inwardly of the opening, said inner wall including an inside portion extending from an inside surface, a sill portion extending from an outside surface of the profile toward the inside of the building and a central raised portion between the inside portion and the sill portion, the inside portion lying parallel to the outer wall and the sill portion being inclined from the raised portion in a direction toward the outside surface and toward the outer surface, means on the inner wall for mounting said window unit in the outer window frame including a tower portion mounted on the central raised portion at a position thereon adjacent the inside portion and projecting inwardly against which the window unit abuts, means defining a nailing fin for abuting an outside wall surface of the building, the nailing fin being located at a position spaced from the outside surface, said inside surface facing inside the building and including means for receiving an inside facing strip at the inside wall surface of the building, and a plurality of interior connecting walls extending across the profile from the inner wall to the outer wall, that portion of the profile extending from the nailing fin to the inside surface being formed as an integral single unit and having a dimension from the nailing fin to the inside surface at least equal to 6.5 inches.

2. The invention according to claim 1 wherein the nailing fin is integral with the profile.

3. The invention according to claim 1 wherein the thickness of the profile between the inside portion of the inner wall and the outer wall is less than 0.770 inches.

4. The invention according to claim 1 wherein the height of the top of the tower from the outer wall is less than 2.1 inches.

5. The invention according to claim 1 wherein said means for receiving an inside facing strip on the inside surface includes a recess therein, and wherein there is provided a facing strip including a projecting member engaged with said recess.

6. The invention according to claim 1 wherein the central raised portion includes recess means therein and wherein there is provided an abutment element including projecting portion is extending into said recess means for cooperation with the tower to receive a picture window unit therebetween.

7. The invention according to claim 6 wherein the tower includes weatherstrip fin means arranged to engage the picture window unit.

8. The invention according to claim 1 including a cross mullion frame profile having a width equal to the width of the central raised portion for extending between the central raised portion on one side of the outer window frame and the central raised portion on an opposed side of the outer window frame.

9. A window frame structure comprising a rectangular outer window frame formed from four outer window profile elements each cut from a common outer window profile extruded from a plastics material to define for each outer window profile element a length and two ends, each end being connected to a respective one of the other outer window profile elements to form said rectangular outer window frame structure and a window unit mounted in the outer window frame, the outer frame profile including an outer wall for engaging an opening formed in a wall of a building, an inner wall facing inwardly of the opening, said inner wall including an inside portion extending from an inside surface, a sill portion extending from an outside surface of the profile toward the inside of the building and a central raised portion between the inside portion and the sill portion, the inside portion lying parallel to the outer wall and the sill portion being inclined from the raised portion in a direction toward the outside surface and toward the outer surface, means on the inner wall for mounting said window unit in the outer window frame including a tower portion mounted on the central raised portion at a position thereon adjacent the inside portion and projecting inwardly against which the window unit abuts, means defining a nailing fin for abuting an outside wall surface of the building, the nailing fin being located at a position spaced from the outside surface, said inside surface facing inside the building and including means for receiving an inside facing strip at the inside wall surface of the building, and a plurality of interior connecting walls extending across the profile from the inner wall to the outer wall, that portion of the profile extending from the nailing fin to the inside surface being formed as an integral single unit and having a dimension from the nailing fin to the inside surface at least equal to 6.5 inches, a cross mullion having a width equal to the width of the central raised portion and extending between the central raised portion on one side of the outer window frame and the central raised portion on an opposed side of the outer window frame, the cross mullion being cut from a cross-mullion profile extruded from a plastics material including an upper wall including a tower projecting upwardly therefrom, a lower wall including a second tower projecting downwardly therefrom, an inside wall and an outside wall, the upper wall including recess means, an abutment portion including projecting means thereon extending into the recess means and fastening the abutment portion to the upper wall to retain a window unit therebetween, and a rectangular sash frame formed from four sash frame profile elements each cut from a common sash frame profile extruded from a plastics material to define for each sash frame profile element a length and two ends, each end being connected to a respective end of one of the other sash frame profile elements to form said rectangular sash frame, the sash frame profile having an inner wall, an outer wall, an outside wall and an inside wall, the inner wall having a lower portion projecting inwardly therefrom and recess means therein, an abutment portion including projecting means thereon extending into the recess means and fastening the abutment portion to the inner wall to retain a window unit therebetween, one sash frame element engaging one outer frame profile element and including a first surface engaging the tower of said one outer frame profile element and a second surface engaging an edge of central raised portion of said one outer frame profile element, a second sash frame profile element opposite to said one sash frame profile element engaging said cross-mullion and including a first surface engaging the second tower of said lower wall and a second surface engaging an edge of the cross-mullion.

10. The invention according to claim 9 wherein the nailing fin is integral with the outer frame profile.

11. The invention according to claim 9 wherein the thickness of the outer frame profile between the inside portion of the inner wall and the outer wall is less than 0.770 inches.

12. The invention according to claim 9 wherein the outer frame profile is arranged such that the height of the top of the tower from the outer wall is less than 2.100 inches.

13. The invention according to claim 9 wherein said means for receiving an inside facing strip on the inside surface of the outer frame profile includes a recess therein, and wherein there is provided a facing strip including a projecting member engaged with said recess.

* * * * *